US009745174B2

(12) United States Patent
Ogawa et al.

(10) Patent No.: US 9,745,174 B2
(45) Date of Patent: Aug. 29, 2017

(54) METHOD FOR CONTROLLING PORT LOADING AND UNLOADING APPARATUS AND PORT LOADING AND UNLOADING APPARATUS

(71) Applicant: MITSUI ENGINEERING & SHIPBUILDING CO., LTD., Tokyo (JP)

(72) Inventors: Satoru Ogawa, Oita (JP); Hiroshi Kasai, Oita (JP); Sho Meno, Oita (JP)

(73) Assignee: MITSUI ENGINEERING & SHIPBUILDING CO., LTD., Tokyo (JP)

( * ) Notice: Subject to any disclaimer, the term of this patent is extended or adjusted under 35 U.S.C. 154(b) by 0 days.

(21) Appl. No.: 14/779,120

(22) PCT Filed: Mar. 28, 2013

(86) PCT No.: PCT/JP2013/059225
§ 371 (c)(1),
(2) Date: Sep. 22, 2015

(87) PCT Pub. No.: WO2014/155598
PCT Pub. Date: Oct. 2, 2014

(65) Prior Publication Data

US 2016/0046466 A1 Feb. 18, 2016

(30) Foreign Application Priority Data

Mar. 26, 2013 (JP) ..... 2013-063727

(51) Int. Cl.
*B66C 13/18* (2006.01)
*B66C 19/00* (2006.01)

(52) U.S. Cl.
CPC ..... *B66C 13/18* (2013.01); *B66C 19/002* (2013.01)

(58) Field of Classification Search
None
See application file for complete search history.

(56) References Cited

U.S. PATENT DOCUMENTS 5,814,955 A * 9/1998 Bauer ..... H02H 7/09 318/376
8,087,867 B2 * 1/2012 Tian ..... B66C 19/002 212/318

(Continued)

FOREIGN PATENT DOCUMENTS

JP 58-104890 A 6/1983
JP 7-304385 A 11/1995

(Continued)

OTHER PUBLICATIONS

International Search Report dated May 21, 2013, issued in counterpart Application No. PCT/JP2013/059225 (2 pages).

*Primary Examiner* — Krishnan Ramesh
(74) *Attorney, Agent, or Firm* — Westerman, Hattori, Daniels & Adrian, LLP

(57) ABSTRACT

A quay crane including auxiliary equipment, which is equipment other than main equipment for performing main operations of the quay crane. The auxiliary equipment includes: a main equipment cooling device for cooling the main equipment; a loading and unloading lighting device for lighting a loading and unloading operation range of the main equipment; a room cooling device for cooling a room; and a room lighting device for lighting the room. If an operating condition of the main equipment or a room condition satisfies a predetermined electric power reduction condition while the quay crane is in operation, the auxiliary equipment that is keeping the operating condition of the main equipment or the room condition is put into a power saving mode in which the auxiliary equipment consumes less electric power than in a normal operation.

7 Claims, 7 Drawing Sheets

(56) References Cited

U.S. PATENT DOCUMENTS

| | | | | |
|---|---|---|---|---|
| 8,234,046 | B2 * | 7/2012 | Ablabutyan | B60P 1/4471 414/495 |
| 8,670,886 | B2 * | 3/2014 | Nishiyama | B66C 13/12 701/22 |
| 2009/0191028 | A1 * | 7/2009 | Tian | B65G 63/004 414/140.3 |
| 2010/0282557 | A1 * | 11/2010 | He | B66C 19/007 191/33 R |
| 2012/0089287 | A1 * | 4/2012 | Nishiyama | B66C 13/12 701/22 |
| 2015/0129330 | A1 * | 5/2015 | Hazebayashi | B60W 10/08 180/53.8 |

FOREIGN PATENT DOCUMENTS

| | | | |
|---|---|---|---|
| JP | 2004-326201 | A | 11/2004 |
| JP | 2005-127618 | A | 5/2005 |
| JP | 2008-253114 | A | 10/2008 |
| JP | 2010-160975 | A | 7/2010 |
| JP | 4616447 | B2 | 1/2011 |
| JP | 2012-188208 | A | 10/2012 |
| JP | 2012-232829 | A | 11/2012 |

* cited by examiner

METHOD FOR CONTROLLING PORT LOADING AND UNLOADING APPARATUS AND PORT LOADING AND UNLOADING APPARATUS

TECHNICAL FIELD

The present invention relates to a method for controlling a port loading and unloading apparatus, and a port loading and unloading apparatus, which reduce electric power to be consumed by auxiliary equipment such as a cooling device and a lighting device for the port loading and unloading apparatus configured to wind up and down a hoisted cargo, and which saves electric power which would be wastefully used if an amount of time taken to load and unload the cargo (hereinafter referred to a cycle time) were not reduced.

BACKGROUND ART

Nowadays, container ships have become larger in size with rapid development of the container transportation system in the international routes. This accordingly demands an increase in the loading and unloading efficiency of the port loading and unloading apparatus (a quay crane, a yard crane or the like) configured to load and unload freight onto and from a container ship. In addition, the society's attention to environmental issues urges energy saving measures for reducing $CO_2$.

Against this background, an apparatus has been provided which includes: a hoisted cargo holding torque calculator configured to calculate hoisted cargo holding torque needed to hold a hoisted cargo on the basis of the weight of the hoisted cargo; a maximum torque calculator configured to calculate maximum torque which a motor configured to wind up and down the hoisted cargo is capable of outputting; and a controller configured to control acceleration of the motor within a range of torque for accelerating the hoisted cargo which is obtained by subtracting the hoisted cargo holding torque from the maximum torque (see Patent Document 1, for example).

This apparatus reduces the cycle time by reducing an amount of time taken to wind up and down the hoisted cargo. As a result, the apparatus is capable of reducing an amount of time taken to load and unload freight, and accordingly its energy consumption.

Meanwhile, the port loading and unloading apparatus includes: main equipment for performing main operations such as loading and unloading work; and auxiliary equipment which is equipment other than the main equipment, and which includes a cooling device for cooling the main equipment whose temperature rises due to heat generated by the loading and unloading work, and a room of the port loading and unloading apparatus, as well as a lighting device for lighting a loading and unloading operation range in order to avoid danger which is involved in work in the dark.

Such auxiliary equipment, such as the cooling device and the lighting device, constantly works while the port loading and unloading apparatus is in operation. Power consumption of the auxiliary equipment accounts for as large as approximately 30% to 60% of overall power consumption of the port loading and unloading apparatus. To reduce electric power to be consumed by the port loading and unloading apparatus, therefore, power consumption during the main operations of the port loading and unloading apparatus needs to be reduced by improving the main operations, and power consumption of the auxiliary equipment also needs to be reduced.

However, the aforementioned apparatus is capable of reducing electric power to be consumed during the main operations, but the apparatus does not reduce electric power to be consumed by the auxiliary equipment.

PRIOR ART DOCUMENT

Patent Document

Patent Document 1: Japanese Patent No. 4616447

SUMMARY OF THE INVENTION

Problem to be Solved by the Invention

Against the background, an object of the present invention is to provide a method for controlling a port loading and unloading apparatus, and a port loading and unloading apparatus, which are capable of: reducing electric power to be consumed by auxiliary equipment which is equipment other than main equipment for performing main operations of the port loading and unloading apparatus such as traveling and winding-up; and accordingly reducing electric power to be consumed by the port loading and unloading apparatus.

Means for Solving the Problem

A method for controlling a port loading and unloading apparatus, according to the present invention, to provide a solution for the aforementioned problem includes auxiliary equipment, which is equipment other than main equipment for performing main operations of the port loading and unloading apparatus, the auxiliary equipment including a main equipment cooling device for cooling the main equipment, a loading and unloading lighting device for lighting a loading and unloading operation range, a room cooling device for cooling a room of the port loading and unloading apparatus, and a room lighting device for lighting the room, the method comprising the step of, if an operating condition of the main equipment or a room condition satisfies a predetermined electric power reduction condition while the port loading and unloading apparatus is in operation, putting the auxiliary equipment that is keeping the operating condition of the main equipment or the room condition into a power saving mode in which the auxiliary equipment consumes less electric power than in a normal operation.

According to this method, the auxiliary equipment which is equipment other than the main equipment (including a main winding motor, a traverse motor and a travel motor), for example a cooling fan for the main winding motor, a ventilation fan for a machine room, an indoor light in a crane driver's cabin and floodlights, can be put into the power saving mode in which they consume less electric power than in the normal operation while the port loading and unloading apparatus is in operation. For this reason, it is possible to suppress the electric power to be consumed by the auxiliary equipment, and to reduce energy to be consumed by the port loading and unloading apparatus.

It should be noted that the power saving mode in this respect is a mode in which the electric power to be consumed is less than in the normal operation mode, and includes a state in which the auxiliary equipment is halted, and a state in which the auxiliary equipment is operated with less electric power. For example, the cooling fan for the main winding motor is operated at lower rotational speed than usual while in the power saving mode, and a floodlight is operated with a smaller amount of light than usual while in the power saving mode.

In addition, in the case of a quay crane, examples of the main operations in this respect include an operation of loading and unloading a container onto and from a ship (a loading and unloading operation). A loading and unloading operation range include an area in which a trolley of the quay crane traverses, and an area in which a hoist gear of the quay crane is wound up and down.

The method for controlling a port loading and unloading apparatus may include at least one of: a first step of, if a temperature of the main equipment becomes equal to or less than a predetermined first main equipment temperature judgment value while the main equipment is in operation, judging that the electric power reduction condition is satisfied, and putting the main equipment cooling device into the power saving mode, and if the temperature of the main equipment becomes equal to or less than a second main equipment temperature judgment value while the main equipment is out of operation, judging that the electric power reduction condition is satisfied, and putting the main equipment cooling device into the power saving mode; and a second step of, if brightness of the loading and unloading operation range becomes equal to or greater than a predetermined main equipment luminance judgment value while the main equipment is in operation, judging that the electric power reduction condition is satisfied, and putting the loading and unloading lighting device into the power saving mode, and if the main equipment is out of operation, judging that the electric power reduction condition is satisfied, and putting the loading and unloading lighting device into the power saving mode. Thereby, the main equipment cooling device and the loading and unloading lighting device, which were supposed to work more than necessary, can be put into the power saving mode, and the energy to be consumed by the auxiliary equipment can be reduced.

For example, while the main winding motor is not in use, and while the temperature of the main winding motor is lower, the cooling fan for cooling the main winding motor can be operated at lower speed than usual, or can be halted. In addition, during a daytime loading and unloading operation, an outdoor floodlight under the crane driver's cabin can be operated with a smaller amount of light than usual, or can be halted.

In addition, the method for controlling a port loading and unloading apparatus may further include: an optimization step of optimizing an operation speed and an operation path of the main equipment using a genetic algorithm where an objective function is to at least reduce an amount of time which it takes to load or unload freight; and a main equipment halting step of operating the main equipment at the operation speed optimized in the optimization step and via the operation path optimized in the optimization step, and halting the main equipment after the loading and unloading operation is completed. Thereby, some of the main operations of the port loading and unloading apparatus, for example the speed at which the trolley traverses, the speed at which the hoisting gear is wound up and down, the path through which the trolley traverses and the path through which the hoisting gear is wound up and down, can be optimized using the genetic algorithm to reduce a time for loading and unloading. Thus, halting the main equipment at an earlier timing reduces electric power which the auxiliary equipment was supposed to consume, leading to more saving of the energy consumption.

It should be noted that the genetic algorithm is a method to obtain an optimal solution by mimicking the process of the evolution of organisms. For example, in this method, new solution candidates are produced from existing solutions by two types of manipulations, a crossover and a mutation; then a solution is selected based on the idea of natural selection; and alternation of generations is repeated to find an optimum solution.

Moreover, the method for controlling a port loading and unloading apparatus may further include a third step of: if a temperature of the room becomes equal to or less than a predetermined room temperature judgment value while the port loading and unloading apparatus is in operation, judging that the electric power reduction condition is satisfied, and putting the room cooling device into the power saving mode; and if brightness of the room becomes equal to or greater than a predetermined room luminance judgment value, judging that the electric power reduction condition is satisfied, and putting the room lighting device into the power saving mode. Thereby, the auxiliary equipment such as the ventilation fan for the machine room and the indoor light in the crane driver's cabin, which were supposed to work more than necessary, can be put into the power saving mode, while the port loading and unloading apparatus is in operation.

A port loading and unloading apparatus according to the present invention to provide a solution for the aforementioned problem includes auxiliary equipment, which is equipment other than main equipment for performing main operations of the port loading and unloading apparatus, the auxiliary equipment including a main equipment cooling device for cooling the main equipment, a loading and unloading lighting device for lighting a loading and unloading operation range, a room cooling device for cooling a room of the port loading and unloading apparatus, and a room lighting device for lighting the room, the apparatus comprising an auxiliary equipment controlling device for, if an operating condition of the main equipment or a room condition satisfies a predetermined electric power reduction condition while the port loading and unloading apparatus is in operation, putting the auxiliary equipment that is keeping the operating condition of the main equipment or the room condition into a power saving mode in which the auxiliary equipment consumes less electric power than in a normal operation.

In addition, A port loading and unloading apparatus may be configured such that the auxiliary equipment controlling device includes at least one of: first means for, if a temperature of the main equipment becomes equal to or less than a predetermined first main equipment temperature judgment value while the main equipment is in operation, judging that the electric power reduction condition is satisfied, and putting the main equipment cooling device into the power saving mode, and if the temperature of the main equipment becomes equal to or less than a second main equipment temperature judgment value while the main equipment is out of operation, judging that the electric power reduction condition is satisfied, and putting the main equipment cooling device into the power saving mode; and second means for, if brightness of the loading and unloading operation range becomes equal to or greater than a predetermined main equipment luminance judgment value while the main equipment is in operation, judging that the electric power reduction condition is satisfied, and putting the loading and unloading lighting device into the power saving mode, and if the main equipment is out of operation, judging that the electric power reduction condition is satisfied, and putting the loading and unloading lighting device into the power saving mode. Thus, the auxiliary equipment, which is conventionally configured to work while the port loading and unloading apparatus is in operation, can be put into the power saving mode depending on the operations of the main equipment.

Thereby, the auxiliary equipment controlling device judges that no problem occurs in the main equipment or the room even if the auxiliary equipment is put into the power saving mode. For this reason, when excessively operated while the port loading and unloading apparatus is in operation, the auxiliary equipment can be put into the power saving mode without adversely affecting the operations of the port loading and unloading apparatus. Since electric power which the auxiliary equipment would otherwise consume can be saved, the power consumption of the port loading and unloading apparatus can be reduced.

Moreover, the port loading and unloading apparatus may further include a controlling device for controlling an operation of the main equipment, in which the controlling device includes an optimization program for optimizing an operation speed and an operation path of the main equipment using a genetic algorithm where an objective function is to at least reduce an amount of time which it takes to load or unload freight, and main equipment halting means for operating the main equipment at the operation speed optimized using the optimization program and via the operation path optimized using the optimization program, and halting the main equipment after the loading and unloading operation is completed. Thereby, the controlling device reduces an amount of time taken for the port loading and unloading apparatus to perform the main operations, and the auxiliary equipment is halted for a length of time equivalent to the reduced amount of time. Thus, the power consumption of the port loading and unloading apparatus can be reduced much more.

Furthermore, the port loading and unloading apparatus may be configured such that the auxiliary equipment controlling device includes fourth means for: if a temperature of the room becomes equal to or less than a predetermined room temperature judgment value while the port loading and unloading apparatus is in operation, judging that the electric power reduction condition is satisfied, and putting the room cooling device into the power saving mode; and if brightness of the room becomes equal to or greater than a predetermined room luminance judgment value, judging that the electric power reduction condition is satisfied, and putting the room lighting device into the power saving mode. Thereby, electric power which the auxiliary equipment consumes can be reduced.

Effects of the Invention

According to the present invention, it is possible to reduce electric power to be consumed by the auxiliary equipment which is the equipment other than the main equipment for performing the main operations, such as traveling and winding-up, of the port loading and unloading apparatus, and accordingly to reduce electric power to be consumed by the port loading and unloading apparatus. In addition, it is possible to reduce the amount of time taken to load and unload freight by optimizing the operations of the main equipment, and accordingly to reduce electric power which the auxiliary equipment would consume if there were no such time reduction.

MODES FOR CARRYING OUT THE INVENTION

Figure 1:
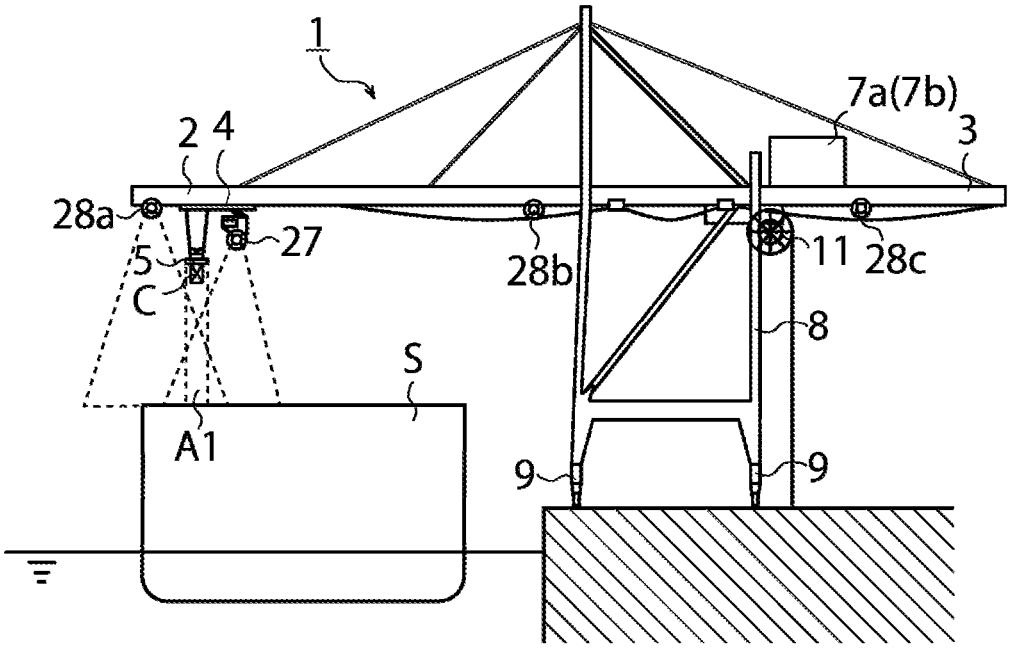
FIG. 1 is a side view showing a port loading and unloading apparatus of an embodiment of the present invention.

Hereinafter, referring to the drawings, descriptions will be provided for a method for controlling a port loading and unloading apparatus, and a port loading and unloading apparatus, of an embodiment of the present invention. It should be noted that: dimensions in the drawings have been changed for the purpose of making components easy to understand; and member-to-member ratios and part-to-part ratios in terms of thickness, width, length and so on are not necessarily equal to those of actual products.

It should be noted that although the embodiment will be described with a quay crane for loading and unloading freight onto and from a ship while traveling along a quay as an example of the port loading and unloading apparatus, the port loading and unloading apparatus to which the present invention is applicable is not limited to the quay crane. For example, the present invention is applicable to port loading and unloading apparatuses inclusive of the quay crane, a yard gantry crane, a goliath crane, a jib crane, a tower crane, an unloader crane, a ceiling crane and a straddle carrier.

First of all, definitions will be given to main equipment, a room and auxiliary equipment. The main equipment is that which works when the port loading and unloading apparatus performs main operations (including loading, unloading and traveling). Examples of the main equipment include: driving devices such as a travel motor for making the port loading and unloading apparatus travel, and a main winding motor for making the port loading and unloading apparatus pull up and down a container; and pieces of equipment which are operated by the driving devices, such as a hoisting gear. The main equipment further includes a power supply unit for supplying electric power to the motors. In addition, examples of the room includes: a machine room to which some of the main equipment is provided; and a crane driver's cabin in which a driver sits.

The auxiliary equipment is that which is other than the foregoing main equipment, and that which assists the main equipment with its work and in performing the main operations safely albeit not directly involved in loading and unloading operations of the port loading and unloading apparatus. Examples of the auxiliary equipment include: a cooling device such as a cooling fan for cooling the main winding motor; and a lighting device such as floodlights for lighting a loading and unloading operation range. The auxiliary equipment is that configured to keep operating conditions of the main equipment (temperature of the main equipment in operation, and illuminance of the operation range of the main equipment) or room conditions (temperature and illuminance of the room) optimal.

In the descriptions of the embodiment, the overall main equipment is referred to as main equipment 10*a*; the overall room, as a room 10*b*; and the overall auxiliary equipment, as auxiliary equipment 20. In addition, out of the auxiliary equipment 20, devices for cooling the main equipment 10*a* are referred to as a main equipment cooling device 20*a*; devices for lighting the operation range of the main equipment 10*a*, as a loading and unloading lighting device 20*b*; devices for cooling the room 10*b*, as a room cooling device 20*c*; and devices for lighting the room 10*b*, as a room lighting device 20*d*.

Figure 2:
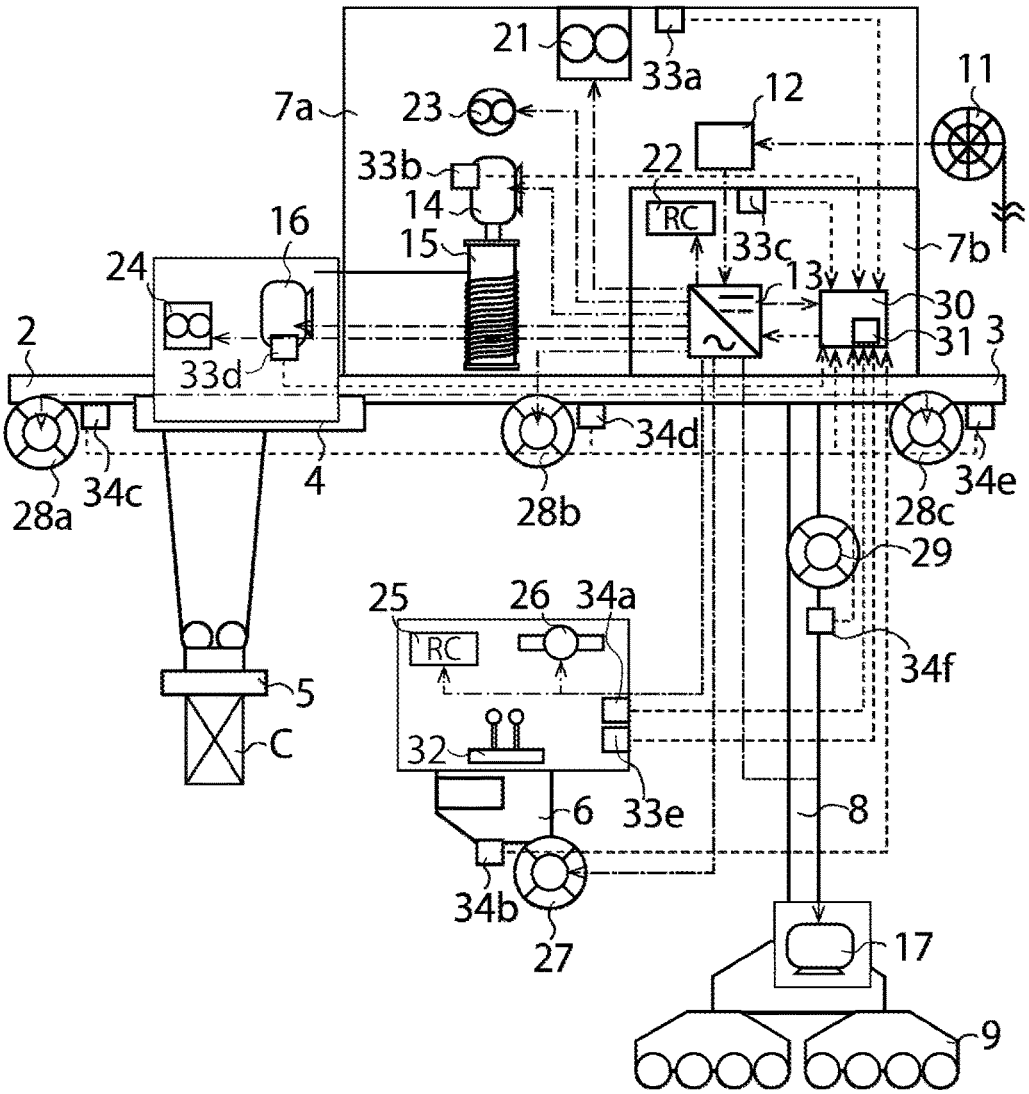
FIG. 2 is a schematic view showing the port loading and unloading apparatus of the embodiment of the present invention.
Figure 3:
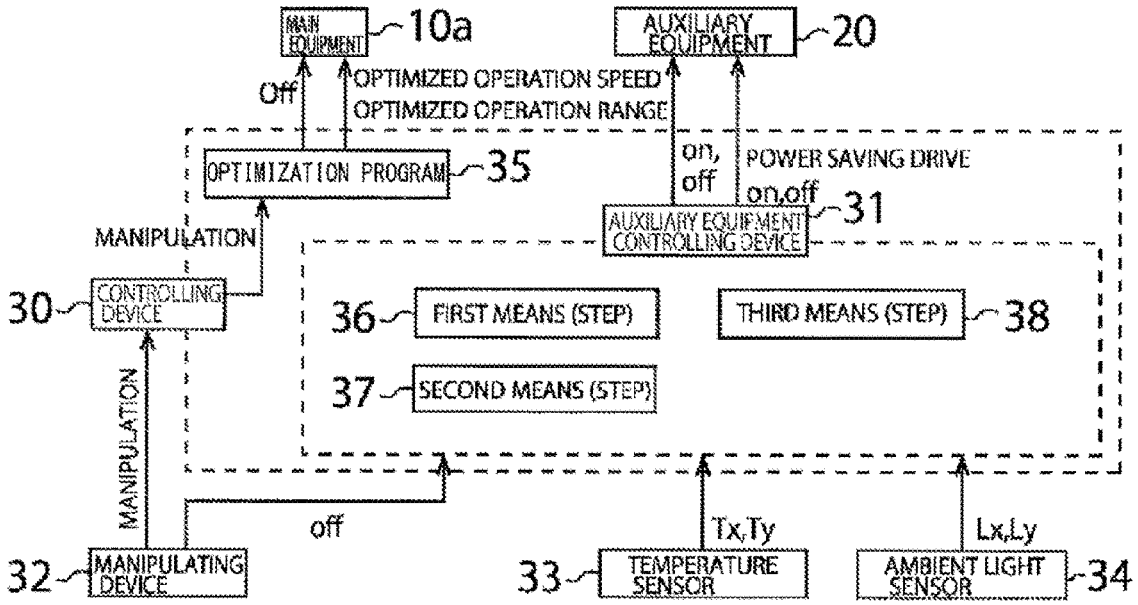
FIG. 3 is a schematic view showing a controlling device and an auxiliary equipment controlling device in the port loading and unloading apparatus of the embodiment of the present invention.

Next, referring to FIGS. 1 to 3, descriptions will be provided for the port loading and unloading apparatus (quay crane) of the embodiment of the present invention. As shown in FIG. 1, the quay crane 1 for loading and unloading freight onto and from a ship S includes a boom 2, a girder 3, a trolley 4, a hoisting gear 5, a leg structure 8 and a crane travel unit 9. The quay crane 1 includes, as the room 10*b*, a crane driver's cabin 6 and a machine room 7*a* (including an electricity room 7*b*).

As shown in FIG. 2, the quay crane 1 further includes, as the main equipment 10*a*, a cable reel 11, a converter 12, an inverter 13, a main winding motor 14, a drum 15, a traverse motor 16 and a travel motor 17. In addition, the quay crane 1 includes, as the main equipment cooling device 20*a*, a main winding motor cooling fan 23 and a traverse motor cooling fan 24. The quay crane 1 includes, as the room cooling device 20*c*, a machine room ventilation fan 21, an electricity room air conditioner 22 and a crane driver's cabin air conditioner 25. Furthermore, the quay crane 1 includes floodlights 27, 28*a* to 28*c*, 29 as the loading and unloading lighting device 20*b*. The quay crane 1 includes a crane driver's cabin light 26 as the room lighting device 20*d*.

It should be noted that an area A1 where the hoisting gear 5 of the quay crane 1 operates is shown as an example of the loading and unloading operation range to be lit by the loading and unloading lighting device 20*b*. The area A1 in the loading and unloading operation range is lit by the floodlight 27 and the floodlight 28*a* in order that the operation of the hoisting gear 5 is visible from the crane driver's cabin 6. The range loading and unloading operation range further includes an area where the trolley 4 traverses.

In this embodiment, the main equipment cooling device 20*a*, the loading and unloading lighting device 20*b*, the room cooling device 20*c* and the room lighting device 20*d* each uses a device which is capable of working in a normal operation mode (operation and halt) and in a reduced power consumption mode (in a power saving mode). For example, the main winding motor cooling fan 23 uses a fan capable of rotating at slower speed than in the normal operation mode, and the crane driver's cabin light 26 uses a light capable of being dimmed by brightness control. The present invention, however, is not limited to these cases, and is also applicable to the auxiliary equipment 20 which has only two control modes, operation and halt.

The embodiment will be described citing the foregoing configuration. However, the present invention is not limited to the foregoing configuration, and is usable to cranes based on well-known art. For example, the present invention is usable to a crane in which a diesel engine is installed as the crane travel unit 9, and a crane using a storage battery as a power source. Furthermore, the quay crane 1 may include a motor, albeit not illustrated, for lifting and lowering the boom 2. In addition, the quay crane 1 may be that in which the machine room 7*a* and the electricity room 7*b* are provided with their respective lights.

In addition to the foregoing configuration, the quay crane 1 of the embodiment of the present invention includes a controlling device 30 provided with an auxiliary equipment controlling device 31, as illustrated in FIG. 3. When the quay crane 1 is operated, a manipulation signal is sent from a manipulating device 32 provided in the crane driver's cabin 6 to the controlling device 30, a control signal is sent from the controlling device 30 to the inverter 13, and the main equipment 10*a* is put into operation. The quay crane 1 further includes temperature sensors 33*a* to 33*e* and ambient light sensors 34*a* to 34*f* which are connected to the controlling device 30.

The controlling device 30, like a personal computer, includes communication means and storage means, and which is configured to control the operation of the main equipment 10*a*. In this embodiment, the controlling device 30 is provided to the electricity room 7*b*. Instead, however, the controlling device 30 may be provided to an administrative building of a container terminal (not illustrated), or the crane driver's cabin 6.

Once the operating conditions of the main equipment 10*a* (the temperatures of the main equipment in operation, and the illuminances of the loading and unloading operation range) or the conditions of the room (temperatures and illuminances in the room) satisfy predetermined electric power reduction conditions, the auxiliary equipment controlling device 31 puts the auxiliary equipment 20, which has kept the operating conditions of the main equipment 10*a* or the conditions of the room, into the power saving mode. The auxiliary equipment controlling device 31 is integrated in the controlling device 30 as a program. Although in the embodiment, the auxiliary equipment controlling device 31 is provided to the controlling device 30, the auxiliary equipment controlling device 31 may be provided separately from the controlling device 30, and can be provided to a different place such as the crane driver's cabin 6.

It should be noted that the power saving mode means either a mode in which the auxiliary equipment 20 is halted or a mode in which the auxiliary equipment 20 works with lower electric power than in the normal operation mode (drives with lower electric power), and is a mode in which power consumption is less than in the normal operation mode.

The temperature sensors 33*a* to 33*e* are temperature sensors based on the well-known art. The temperature sensors 33*a* to 33*e* respectively detect the temperature inside the machine room 7*a*, the temperature of the main winding motor 14, the temperature in the electricity room 7*b*, the temperature of the traverse motor 16, and the temperature inside the crane driver's cabin 6. The ambient light sensors 34*a* to 34*f* are ambient light sensors based on the well-known art. The ambient light sensor 34*a* detect the illuminance inside the crane driver's cabin 6; the ambient light sensor 34*b* detects the illuminance in an area where the hoisting gear 5 is wound up and down (a part of the loading and unloading operation range) under the crane driver's cabin 6; the ambient light sensors 34*c* to 34*e* detect the illuminances in another area where the trolley 4 traverses (other parts of the loading and unloading operation range) under the boom 2 or the girder 3; and the ambient light sensor 34*f* detects the illuminance of an upper portion of the leg structure 8.

The quay crane 1 having the foregoing configuration is characterized in that once the operating conditions of the main equipment 10*a* or the conditions of the room 10*b* satisfy the predetermined electric power reduction conditions while the quay crane 1 is in operation, the quay crane 1 puts the auxiliary equipment 20, which has kept the operating conditions of the main equipment 10*a* or the conditions of the room 10*b*, into the power saving mode in which the power consumption is less than in the normal operation mode. The quay crane 1 is capable of reducing its power consumption.

Next, descriptions will be provided for how the auxiliary equipment 20 of the quay crane 1 works as shown in FIG. 3. The quay crane 1 receives electric power from the cable reel 11, and distributes the electric power to the devices from the inverter 13 provided inside the electricity room 7*b*. The controlling device 30 controls the inverter 13 in accordance with manipulation of the manipulating device 32. Thereby, the traverse motor 16 drives, and the trolley 4 thus traverses; the main winding motor 14 drives, the drum 15 thus rotates, and the hoisting gear 5 is hence wound up and down; and the travel motor 17 drives, and the quay crane 1 travels.

During these main operations, the temperatures rise in the main equipment 10*a* or the room 10*b*. For this reason, the main equipment 10*a* or the room 10*b* is cooled by also driving the machine room ventilation fan 21, the electricity room air conditioner 22, the main winding motor cooling fan 23, the traverse motor cooling fan 24 and the crane driver's cabin air conditioner 25.

Furthermore, during work in bad weather or at night time, the floodlights 27, 28*a* to 28*c*, 29 of the loading and unloading lighting device 20*b* light the loading and unloading operation range (for example, the area A1 in the loading and unloading operation range) since the darkness hinders the work from being performed safely.

The auxiliary equipment 20 is that which is not involved in the main operations of the quay crane 1, and is not limited to the above-mentioned kinds of devices. For example, when the quay crane 1 is configured to raise or lower the boom 2, a fan for cooling a drive motor used to raise and lower the boom 2 is included in the auxiliary equipment 20 as well. In addition, when the self-cooling type travel motor 17 of the embodiment is replaced with a travel motor which needs to be cooled by a separate cooling fan, such a cooling fan is also included in the auxiliary equipment 20. Furthermore, if other kinds of auxiliary equipment are used, sensors are simultaneously adopted with the roles of the auxiliary equipment taken into consideration.

Next, descriptions will be provided for the controlling device 30 and the auxiliary equipment controlling device 31. As shown in FIG. 3, the controlling device 30 includes an optimization program 35 in addition to the auxiliary equipment controlling device 31. In addition, the auxiliary equipment controlling device 31 includes first means (step) 36, second means (step) 37, and third means (step) 38. Incidentally, in this drawing, the temperature sensors 33*a* to 33*e* are generically shown as a temperature sensor 33, and the ambient light sensors 34*a* to 34*f* are generically shown as an ambient light sensor 34. In addition, arrows in the drawing represent the flows of signals.

The above-described main equipment 10*a* is controlled and operated via the manipulating device 32. To put it specifically, the main equipment 10*a* is actually operated with the optimization program 35 of the controlling device 30 optimizing the operation speed and operation route of the main equipment 10*a*. Otherwise, the operation speed and operation route of the main equipment 10*a* may be controlled by being optimized using the optimization program 35 in advance.

The optimization program 35 is a program for optimizing variables in an objective function using a genetic algorithm, where: the objective function is to at least reduce an amount of time which it takes to load or unload freight; and variables represent the rotational speeds, rotational accelerations and rotational decelerations of the main winding motor 14 and the traverse motor 16, or the operation routes of the trolley 4 and the hoisting gear 5 (for example, the traverse distance of the trolley 4 and the winding-up/down length of the hoisting gear 5).

The genetic algorithm is a method to obtain an optimal solution by mimicking the process of the evolution of organisms. For example, in this method, new solution candidates are produced from existing solutions by two types of manipulations, a crossover and a mutation; then a solution is selected based on the idea of natural selection; and alternation of generations is repeated to find an optimum solution.

For example, when the hoisting gear 5 is wound up and down by driving the main winding motor 14, the optimization can be used to reduce an amount of time taken to wind up and down the hoisting gear 5 by setting large values to the rotational acceleration and rotational deceleration of the main winding motor 14 before the hoisting gear 5 reaches a maximum winding-up/down speed. In addition, the optimization can be used also to prevent useless motions of the hoisting gear 5 or the trolley 4 by making the hoisting gear 5 wound up and down an exact length, or the trolley 4 traverse an exact distance.

The operation of the main equipment 10*a* using the optimization program 35 makes the main equipment 10*a* work at the optimized operation speeds through the optimized operation paths, and can accordingly reduce an amount of time taken to load and unload the freight.

In addition, if the controlling device 30 is provided with means for halting the main equipment 10*a* at a time of completion of the loading and unloading work by the main equipment 10*a*, the power consumption can be reduced for the reduced amount of time by shortening loading and unloading time of the quay crane 1. For this reason, it is possible to provide the quay crane 1 with less power consumption.

This embodiment has been described citing the example where the operation speeds and operation paths of the main equipment 10*a* are optimized by the optimization program 35. Nevertheless, if an unloader, for example, is used as a port loading and unloading apparatus, an amount of loads to be grabbed by a bucket may be optimized.

Here, effects of the optimization program 35 will be explained by referring to a graph in FIG. 4 and a graph in FIG. 5. Depending on whether or not the controlling device 30 of the quay crane 1 is provided with the optimization program 35, the graph in FIG. 4 shows an amount of time taken for the main winding motor 14 to work and a speed at which the hoisting gear 5 is wound up and down, and the graph in FIG. 5 shows the amount of time taken for the main winding motor 14 to work and an amount of power that the main winding motor 14 consumes.

Figure 4:
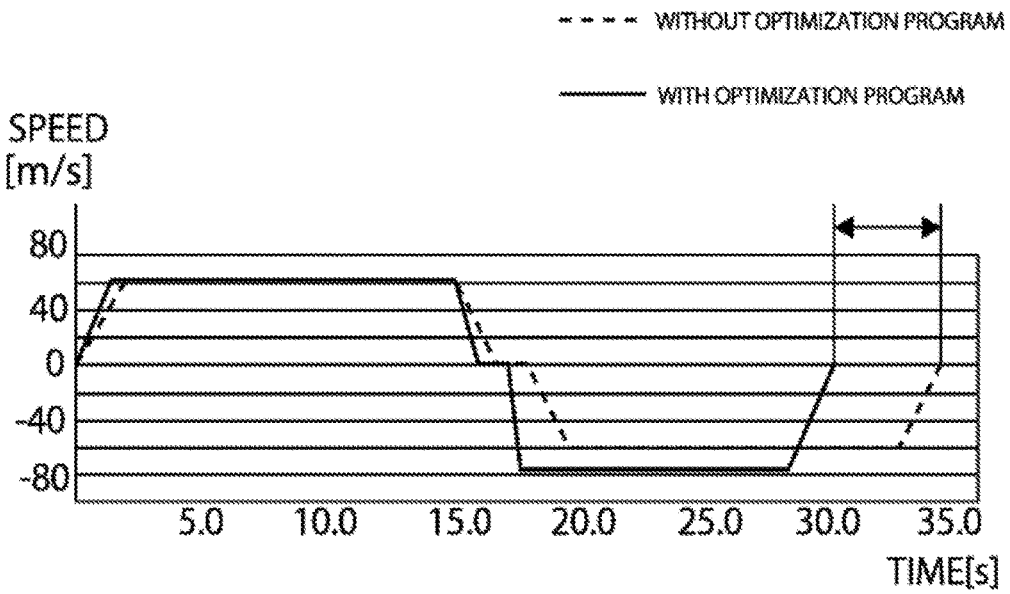
FIG. 4 is a graph showing a relationship between speed and time in loading and unloading work by the port loading and unloading apparatus of the embodiment of the present invention for a case using means for reducing an amount of time taken to load and unload freight, and for a case using no such means.

It is learned that as shown in FIG. 4, the use of the optimization program 35 increases the acceleration at which the hoisting gear 5 is wound up and the deceleration at which the hoisting gear 5 is wound down. In addition, the use of the optimization program 35 increases the maximum speed at which the hoisting gear 5 is wound down. From this comparison between the presence and absence of the optimization program 35, it is learned that the use of the optimization program 35 shortens the amount of time taken to complete the work.

Figure 5:
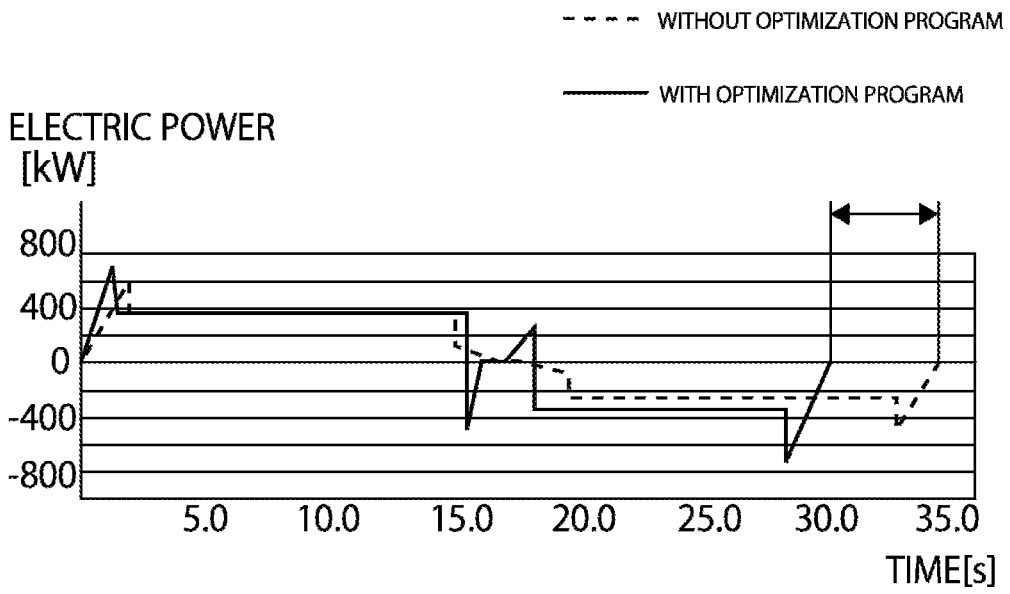
FIG. 5 is a graph showing a relationship between power consumption and time in the loading and unloading work by the port loading and unloading apparatus of the embodiment of the present invention for the case using means for reducing an amount of time taken to load and unload freight, and for the case using no such means.

Furthermore, it is learned that as shown in FIG. 5, the use of the optimization program 35 increases an amount of electric power which is consumed when the hoisting gear 5 is wound up, particularly when the hoisting gear 5 is accelerated. On the other hand, the use of the optimization program 35 increases regenerative electric power which is generated while the hoisting gear 5 is being wound down. For this reason, it is learned that the use of the optimization program 35 causes almost no change in the amount of electric power to be consumed while the hoisting gear 5, which is a piece of the main equipment 10*a*, is being wound up and down.

Thereby, the auxiliary equipment 20 can be halted by the reduced amount of loading and unloading time by use of the optimized program 35. Accordingly, the amount of electric power to be consumed by the quay crane 1 can be reduced. This is because for a length of time equal to the reduced amount of loading and unloading time, the auxiliary equipment controlling device 31 can halt the auxiliary equipment 20 which would otherwise work, and accordingly reduces the power consumption.

The auxiliary equipment controlling device 31 will be described. The auxiliary equipment controlling device 31 puts the auxiliary equipment 20 into operation, into a halt or into the power saving mode by sending a control signal to the inverter 13 to control supplied electric power. In this respect, it should be noted that: the temperature of the main equipment 10*a* is denoted by Tx; the temperature of the room 10*b*, Ty; the luminance of the loading and unloading operation range, Lx; the luminance of the room 10*b*, Ly; a first main equipment temperature judgment value, Tα; a second main equipment temperature judgment value, Tβ; a room temperature judgment value, Tσ; a main equipment luminance judgment value, Lα; and a room illuminance judgment value, Lβ.

The first means 36 is means configured such that: while the main equipment 10*a* is in operation, if the temperature Tx of the main equipment 10*a* becomes equal to or less than the predetermined first main equipment temperature judgment value Tα, the first means 36 judges that an electric power reduction condition is satisfied, and puts the main equipment cooling device 20*a* into the power saving mode; and while the main equipment 10*a* is out of operation, if the temperature Tx of the main equipment 10*a* becomes equal to or less than the predetermined second main equipment temperature judgment value Tβ, the first means 36 judges that the electric power reduction condition is satisfied, and puts the main equipment cooling device 20*a* into the power saving mode.

For example, while the main winding motor 14 is in operation, if the temperature Tx of the main winding motor 14 detected by the temperature sensor 33*b* becomes lower than the first main equipment temperature judgment value Tα, the first means 36 makes the main winding motor cooling fan 23 operate with lower electric power (rotate at lower speed), or halts the main winding motor cooling fan 23. Meanwhile, if the temperature Tx becomes higher than the first main equipment temperature judgment value Tα, the first means 36 makes the main winding motor cooling fan 23 start to operate. Furthermore, after the main winding motor 14 completes its operation, if the temperature Tx of the main winding motor 14 detected by the temperature sensor 33*b* becomes lower than the first main equipment temperature judgment value Tα, the first means 36 makes the main winding motor cooling fan 23 operate with lower electric power (rotate at lower speed), or halts the main winding motor cooling fan 23.

The second means 37 is means configured such that: while the main equipment 10*a* is in operation, if the luminance Lx of the loading and unloading operation range becomes equal to or greater than the predetermined main equipment luminance judgment value Lα, the second means 37 judges that the electric power reduction condition is satisfied, and puts the loading and unloading lighting device 20*b* into the power saving mode; and if the main equipment 10*a* is out of operation, the second means 37 puts the loading and unloading lighting device 20*b* into the power saving mode.

For example, while the hoisting gear 5 is in operation, the luminance Lx of an area lit by the floodlight 27, which is the detection range of the ambient sensor 34*b*, or apart of the loading and unloading operation range by the hoisting gear 5, becomes higher than the main equipment luminance judgment value Lα, the second means 37 makes the floodlight 27 operate with lower electric power (dims the floodlight 27), or halts the floodlight 27. Meanwhile, if the luminance Lx becomes lower than the main equipment luminance judgment value Lα, the second means 37 makes the floodlight 27 start to work. In addition, after the hoisting gear 5 completes its operation, the second means 37 dims the floodlight 27, or halts the floodlight 27.

The third means 38 judges that the electric power reduction condition is satisfied when the room temperature Ty becomes equal to or less than the predetermined room temperature judgment value Tσ, or when the room luminance Ly becomes equal to or greater than the predetermined room illuminance judgment value Lβ, and then puts the room cooling device 20*c* or the room lighting device 20*d* into the power saving mode respectively.

For example, if the room temperature Ty detected by the temperature sensor 33*a* provided to the machine room 7*a* becomes lower than the room temperature judgment value Tσ, the third means 38 operates the machine room ventilation fan 21 at lower speed, or halts the machine room ventilation fan 21. Meanwhile, if the room luminance Ly detected by the ambient light sensor 34*a* provided to the crane driver's cabin 6 becomes equal to or greater than the room illuminance judgment value Lβ, the third means 38 dims the crane driver's cabin light 26, or halts the crane driver's cabin light 26.

In this embodiment, the auxiliary equipment 20 of the quay crane 1 is halted by use of the first to third means 36 to 38. The auxiliary equipment 20 may be configured such that no matter how the main equipment 10*a* is operating while the quay crane 1 is in operation, the auxiliary equipment 20 can be halted within a range which allows the main equipment 10*a* to operate safely. For example, the loading and unloading apparatus may be provided with means for, when the main equipment 10*a* halts, judging that the electric power reduction condition is satisfied, and putting the auxiliary equipment 20 into the power saving mode.

Figure 6:
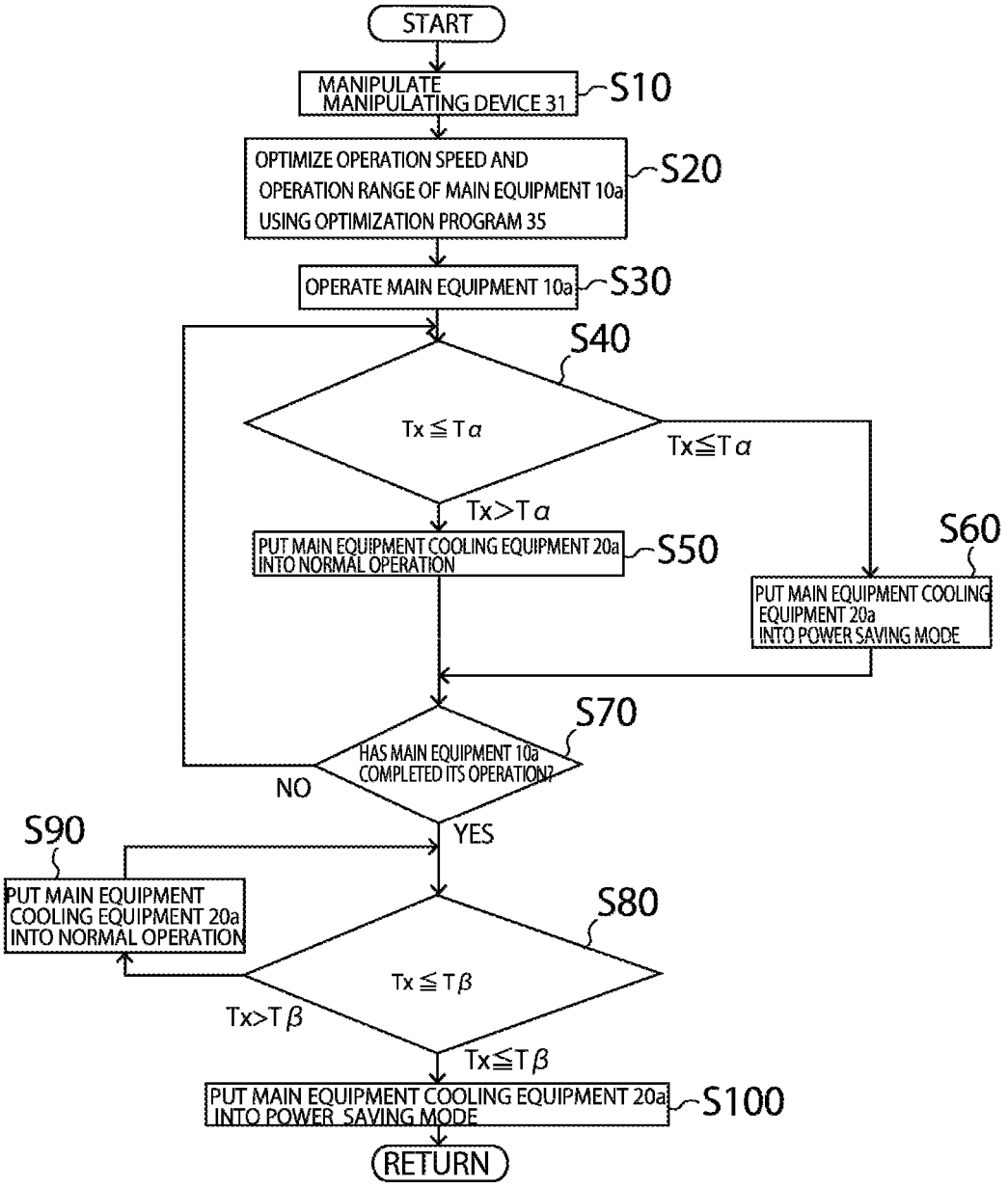
FIG. 6 is a flowchart showing a first step in a method for controlling a port loading and unloading apparatus of the embodiment of the present invention.
Figure 7:
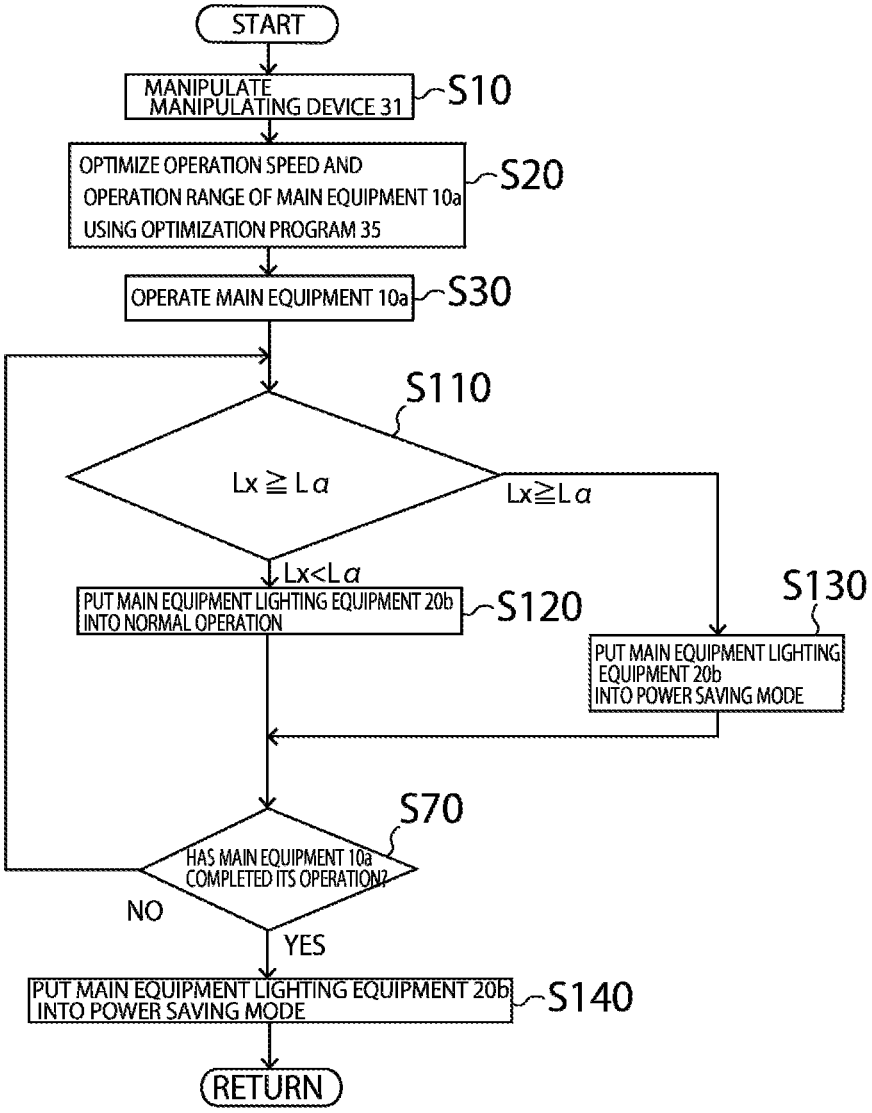
FIG. 7 is a flowchart showing a second step in the method for controlling a port loading and unloading apparatus of the embodiment of the present invention.
Figure 8:
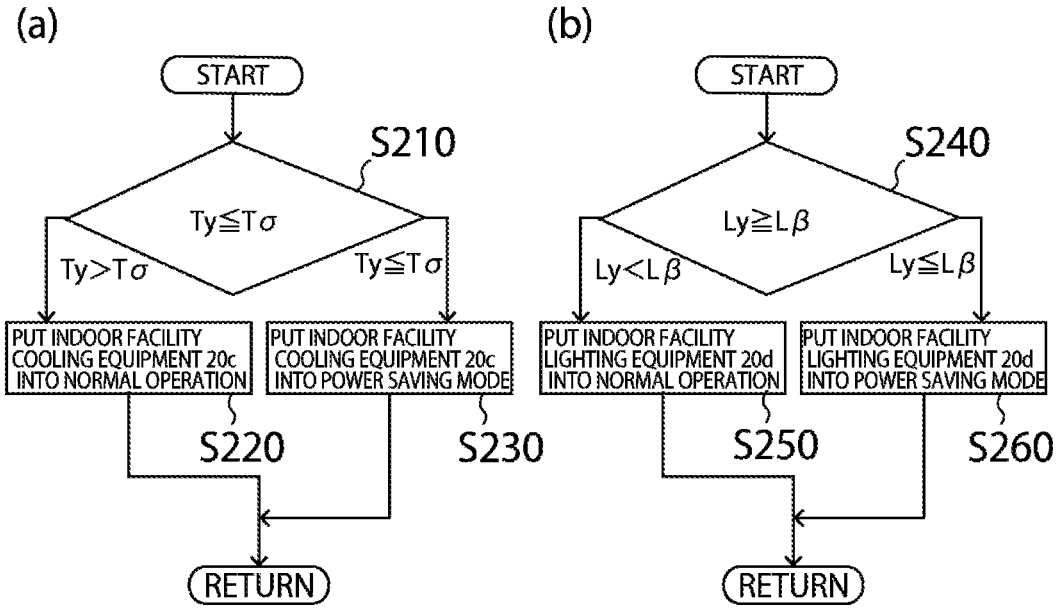
FIG. 8 is a flowchart showing a third step in the method for controlling a port loading and unloading apparatus of the embodiment of the present invention; Part (a) shows a method for controlling a room cooling device; and Part (b) shows a method for controlling a room lighting device.

Next, referring to FIGS. 6 to 8, descriptions will be provided for a method for controlling the port loading and unloading apparatus of the embodiment of the present invention. First of all, referring to FIG. 6, descriptions will be provided for a first step which is a method of controlling the main equipment cooling device 20*a*.

When the loading and unloading work starts with the operation of the quay crane 1, the driver manipulates the manipulating device 32 (step S10). Thereafter, a manipulation signal inputted into the manipulating device 32 is transmitted to the controlling device 30, and the controlling device 30 performs an optimization step. This optimization step is a step (Step S20) of optimizing the operation speed and operation path of the main equipment 10*a* using the optimization program 35. In this step, the operation speed and operation path of the main equipment 10*a* is optimized using the genetic algorithm in which the objective function is to at least reduce the amount of time which it takes to load or unload freight.

It should be noted that if for the purpose of inhibiting a rise in the temperature of the main equipment 10*a*, an objective function is added to the optimization process in step S20, the rise in the temperature of the main equipment 10*a* can be inhibited. For this reason, a length of time for which the main equipment cooling device 20*a* is halted can be extended, and a further reduction in the power consumption can be achieved.

Otherwise, a configuration may be employed in which: step S20 is performed in advance, and the optimized operation speed and operation path of the main equipment 10*a* are stored in the controlling device 30; and the optimized operation speed and operation path thereof are read in accordance with the manipulation of the manipulating device 32.

Subsequently, the controlling device 30 operates the main equipment 10*a* (step S30). Then, the temperature sensor 33 detects the temperature Tx of the main equipment 10*a*, and the auxiliary equipment controlling device 31 judges whether or not the temperature Tx of the main equipment 10*a* is not greater than the first main equipment temperature judgment value Tα (step S40).

If the auxiliary equipment controlling device 31 judges in step S40 that the temperature Tx of the main equipment 10*a* is greater than the first main equipment temperature judgment value Tα, the auxiliary equipment controlling device 31 subsequently puts the main equipment cooling device 20*a* into normal operation (step S50). Thereby, the main equipment 10*a* is cooled, and an excessive rise in the temperature Tx of the main equipment 10*a* can be prevented.

On the other hand, if the auxiliary equipment controlling device 31 judges in step S40 that the temperature Tx of the main equipment 10*a* is equal to or less than the first main equipment temperature judgment value Tα, the auxiliary equipment controlling device 31 subsequently puts the main equipment cooling device 20*a* into the power saving mode (step S60). In step S60, the amount of electric power to be consumed by the main equipment cooling device 20*a* can be reduced while inhibiting excessive cooling of the main equipment 10*a*.

Steps S40 through S60 are those performed with the temperature Tx of the main equipment 10*a* always monitored until the operation of the main equipment 10*a* is completed. Steps S40 through S60 may be performed at intervals of a predetermined length of time.

Next, the controlling device 30 judges whether or not the operation of the main equipment 10*a* is completed (step S70). In step S70, the controlling device 30 judges that the operation of the main equipment 10*a* is completed, when the main equipment 10*a* completes its operation in accordance with a manipulation signal from the manipulating device 32 and the controlling device 30 halts the main equipment 10*a* by performing a main equipment halting process.

Next, the temperature sensor 33 detects the temperature Tx of the main equipment 10*a* after the main equipment 10*a* halts, and the auxiliary equipment controlling device 31 judges whether or not the temperature Tx of the main equipment 10*a* is not greater than the second main equipment temperature judgment value Tβ (step S80). If the auxiliary equipment controlling device 31 judges that the temperature Tx of the main equipment 10*a* is greater than the second main equipment temperature judgment value Tβ, the auxiliary equipment controlling device 31 subsequently puts the main equipment cooling device 20*a* into normal operation (step S90), and returns to step S80. On the other hand, if the auxiliary equipment controlling device 31 judges that the temperature Tx of the main equipment 10*a* is equal to or less than the second main equipment temperature judgment value Tβ in step S80, the auxiliary equipment controlling device 31 subsequently puts the main equipment cooling device 20*a* into the power saving mode (step S100). With this, the method for controlling the main equipment cooling device 20*a* ends.

The first main equipment temperature judgment value Tα and the second main equipment temperature judgment value Tβ are values which can be set arbitrarily, and may be set at such values that the main equipment 10*a* can be prevented from overheating. It is desirable that: like in this embodiment, the first main equipment temperature judgment value Tα and the second main equipment temperature judgment value Tβ be set separately; and the second main equipment temperature judgment value Tβ be set higher than the first main equipment temperature judgment value Tα. If the main equipment judgment values are so set, electric power loss due to excessive cooling can be prevented since while the main equipment 10*a* is out of operation (after the main equipment 10*a* halts), the main equipment 10*a* is no longer heated.

According to this method, the main equipment cooling device 20*a* can be put into the power saving mode on the basis of the comparison of the temperature Tx of the main equipment 10*a* with either of the main equipment temperature judgment values Tα, Tβ. For this reason, the main equipment 10*a* can be prevented from being excessively cooled, and the power consumption can be reduced by an amount of electric power which the main equipment cooling device 20*a* would consume if it cooled the main equipment 1 excessively. Accordingly, the amount of energy to be consumed by the quay crane 1 can be reduced.

Furthermore, since the operation speed and operation path of the main equipment 10*a* is optimized using the optimization program 35, the main equipment 10*a* can be halted earlier than when the optimization program 35 is not used. Accordingly, the main equipment cooling device 20*a* can be put into the power saving mode earlier as well. Thus, the power consumption can be reduced.

Let us assume that for example, the trolley 4 is traversed by the traverse motor 16 which is driven in accordance with a manipulation signal from the manipulating device 32. If the temperature of the traverse motor 16 rises and the temperature Tx of the traverse motor 16 detected by the temperature sensor 33*d* becomes greater than the first main equipment temperature judgment value Tα, the traverse motor cooling fan 24 is driven to cool the traverse motor 16. On the other hand, if the temperature Tx while the traverse motor 16 is in operation becomes equal to or less than the first main equipment temperature judgment value Tα, the traverse motor cooling fan 24 is put into the power saving mode by rotating the traverse motor cooling fan 24 at lower speed than usual.

Subsequently, the traverse motor 16 is halted in accordance with a manipulation signal from the manipulating device 32, and the trolley 4 is thus halted. Thereafter, if the temperature of the traverse motor 16 decreases and the temperature Tx of the traverse motor 16 detected by the temperature sensor 33*d* becomes equal to or less than the second main equipment temperature judgment value Tβ, the traverse motor cooling fan 24 is halted.

Thereby, the traverse motor cooling fan 24 can be halted while the traverse motor 16 is not in use, and while the temperature Tx of the traverse motor 16 is lower. Accordingly, the power consumption can be reduced by an amount of electric power which the traverse motor cooling fan 24 would consume if it could not be halted.

Next, referring to FIG. 7, descriptions will be provided for a method for controlling the loading and unloading lighting device 20*b*. Incidentally, the same steps as those described in the flowchart in FIG. 6 will be denoted by the same reference signs, and descriptions for such steps will be omitted. First of all, once steps S10 through S30 are completed, the ambient light sensor 34 detects the luminance Lx of the loading and unloading operation range, and the auxiliary equipment controlling device 31 judges whether or not the luminance Lx of the loading and unloading operation range is not less than the main equipment luminance judgment value Lα (step S110).

If the auxiliary equipment controlling device 31 judges in step S110 that the luminance Lx thereof is less than the main equipment luminance judgment value Lα, the auxiliary equipment controlling device 31 subsequently puts the loading and unloading lighting device 20*b* into normal operation (step S120). Thereby, before the loading and unloading work is started, the luminance of the loading and unloading operation range can be made enough for safe work.

On the other hand, if the auxiliary equipment controlling device 31 judges in step S110 that the luminance Lx thereof is equal to or greater than the main equipment luminance judgment value Lα, the auxiliary equipment controlling device 31 subsequently puts the loading and unloading lighting device 20*b* into the power saving mode (step S130). By step S130, the power consumption of the loading and unloading lighting device 20*b* can be reduced by preventing excessive brightness for the loading and unloading operation range.

Steps S110 through S130 are performed with the luminance Lx of the main equipment 10*a* always monitored until the operation of the main equipment 10*a* is completed. Preferably, steps S110 through S130 may be performed at intervals of a predetermined length of time.

Next, the controlling device 30 judges whether or not the operation of the main equipment 10*a* is completed (step S70). In step S70, the controlling device 30 judges that the operation of the main equipment 10*a* is completed, when the main equipment 10*a* completes its operation in accordance with a manipulation signal from the manipulating device 32 and the controlling device 30 halts the main equipment 10*a* by performing a main equipment halting process. If the controlling device 30 judges that the operation of the main equipment 10*a* is completed, the auxiliary equipment controlling device 31 subsequently puts the loading and unloading lighting device 20*b* into the power saving mode (step S140). With this, the method for controlling the loading and unloading lighting device 20*b* ends.

According to the foregoing control method, before the main equipment 10*a* starts its operation, the loading and unloading lighting device 20*b* can be put into the power saving mode on the basis of the luminance Lx of the operation range of the main equipment 10*a*; and after the main equipment 10*a* halts, the loading and unloading lighting device 20*b* can be immediately put into the power saving mode. For these reasons, the energy consumption of the quay crane 1 can be reduced while reducing the electric power which the loading and unloading lighting device 20*b* would otherwise consume although it need not be operated.

Furthermore, since the operation speed and operation path of the main equipment 10*a* is optimized using the optimization program 35, the main equipment 10*a* can be halted earlier than when the optimization program 35 is not used. Accordingly, the power consumption can be reduced by an amount of electric power which the main equipment 10*a* would consume if it were not halted earlier.

For example, when the hoisting gear 5 is wound up and down, if the luminance lx of a corresponding part of the loading and unloading operation range detected by the ambient light sensor 34*b* installed under the crane driver's cabin 6 becomes less than the main equipment luminance judgment value Lα, the auxiliary equipment controlling device 31 operates the floodlight 27. Once the floodlight 27 makes the corresponding part of the loading and unloading operation range bright, the hoisting gear 5 starts to be wound up and down. On the other hand, if the luminance Lx thereof becomes equal to or greater than the main equipment luminance judgment value Lα while the hoisting gear 5 is in operation, the auxiliary equipment controlling device 31 dims the floodlight 27 by brightness control.

Once the winding up and down of the hoisting gear 5 is completed, the main winding motor 14 is halted. Subsequently, the floodlight 27 is halted. Thereby, the floodlight 27 to be used to check the winding-up/down operation of the hoisting gear 5 can be halted while the hoisting gear 5 is not in use. Accordingly, the power consumption can be reduced by an amount electric power which the hoisting gear 5 would consume if it could not be halted.

On the other hand, the ambient light sensors 34*c* to 34*e* for detecting the luminances of the areas to be lit by the multiple floodlights 28*a* to 28*c* under the boom 2 or the girder 3 may be configured to, if detecting that any one of the areas to be lit by the floodlights 28*a* to 28*c* comes under the shadow of the trolley 4, turn off a floodlight which is under the shadow of the trolley 4, and to reduce the power consumption by an amount of electric power which the floodlight would consume if it were not turned off.

Next, referring to FIG. 8, descriptions will be provided for a method for controlling the room cooling device 20*c*, and a method for controlling the room lighting device 20*d*. While the quay crane 1 is in operation, it is judged whether or not the room temperature Ty of the room 10*b* becomes equal to or less than the room temperature judgment value Tσ (step S210), as shown in FIG. 8(*a*). If it is judged that the room temperature Ty thereof is greater than the room temperature judgment value Tσ, the auxiliary equipment controlling device 31 puts the room cooling device 20*c* into normal operation (step S220). On the other hand, if it is judged that the room temperature Ty thereof is equal to or less than the room temperature judgment value Tσ, the auxiliary equipment controlling device 31 puts the room cooling device 20*c* into the power saving mode (step S230).

Meanwhile, while the quay crane 1 is in operation, it is judged whether or not the room luminance Ly of the room 10*b* becomes equal to or greater than the room illuminance judgment value Lβ (step S240), as shown in FIG. 8(*b*). If it is judged that the room luminance Ly thereof is less than the room illuminance judgment value Lβ, the auxiliary equipment controlling device 31 puts the room lighting device 20*d* into normal operation (step S250). On the other hand, if it is judged that the room luminance Ly thereof is equal to or greater than the room illuminance judgment value Lβ, the auxiliary equipment controlling device 31 puts the room lighting device 20*d* into the power saving mode (step S260).

For example, the foregoing control methods are applicable to the crane driver's cabin air conditioner 25 and the crane driver's cabin light 26 for the crane driver's cabin 6. In addition, the room 10*b* may be provided with a sensor for: detecting the entrance of the driver or an inspector into the room 10*b*, and for; if detecting the entrance in the room 10*b*, operating the room cooling device 20*c*, and the room lighting device 20*d*.

INDUSTRIAL APPLICABILITY

The port loading and unloading apparatus of the present invention can reduce electric power to be consumed by the auxiliary equipment which is other than the main equipment for carrying out the main operation, and can accordingly reduce its energy consumption, since the port loading and unloading apparatus controls the auxiliary equipment separately from the operations of the main equipment. For these reason, the port loading and unloading apparatus can be used as the quay crane or yard crane with less power consumption.

EXPLANATION OF REFERENCE NUMERALS

1 quay crane
2 boom
3 girder
4 trolley
5 hoisting gear
6 crane driver's cabin
7*a* machine room
7*b* electricity room
8 leg structure
9 crane travel unit
10*a* main equipment
10*b* room
11 cable reel
12 converter
13 inverter
14 main winding motor
15 drum
16 traverse motor
17 travel motor
20 auxiliary equipment
20*a* main equipment cooling device
20*b* loading and unloading lighting device
20*c* room cooling device
20*d* room lighting device
21 machine room ventilation fan
22 electricity room air conditioner
23 main winding motor cooling fan
24 traverse motor cooling fan
25 crane driver's cabin air conditioner
26 crane driver's cabin light
27, 28*a* to 28*c*, 29 floodlights
30 controlling device
31 auxiliary equipment controlling device
32 manipulating device
33 temperature sensor
34 ambient light sensor
35 optimization program
36 first means (step)
37 second means (step)
38 third means (step)

The invention claimed is:

1. A method for controlling a port loading and unloading apparatus including
- auxiliary equipment, which is equipment other than main equipment for performing main operations of the port loading and unloading apparatus,
- the auxiliary equipment including
- a main equipment cooling device for cooling the main equipment,
- a loading and unloading lighting device for lighting a loading and unloading operation range,
- a room cooling device for cooling a room of the port loading and unloading apparatus, and
- a room lighting device for lighting the room,
- the method comprising the step of
- if an operating condition of the main equipment or a room condition satisfies a predetermined electric power reduction condition while the port loading and unloading apparatus is in operation, putting the auxiliary equipment that is keeping the operating condition of the main equipment or the room condition into a power saving mode in which the auxiliary equipment consumes less electric power than in a normal operation.

2. The method for controlling a port loading and unloading apparatus according to claim 1, comprising at least one of:
- a first step of,
  - if a temperature of the main equipment becomes equal to or less than a predetermined first main equipment temperature judgment value while the main equipment is in operation, judging that the electric power reduction condition is satisfied, and putting the main equipment cooling device into the power saving mode, and
  - if the temperature of the main equipment becomes equal to or less than a second main equipment temperature judgment value while the main equipment is out of operation, judging that the electric power reduction condition is satisfied, and putting the main equipment cooling device into the power saving mode; and
- a second step of,
  - if brightness of the loading and unloading operation range becomes equal to or greater than a predetermined main equipment luminance judgment value while the main equipment is in operation, judging that the electric power reduction condition is satisfied, and putting the loading and unloading lighting device into the power saving mode, and
  - while the main equipment is out of operation, judging that the electric power reduction condition is satisfied, and putting the loading and unloading lighting device into the power saving mode.

3. The method for controlling a port loading and unloading apparatus according to claim 2, further comprising:
- an optimization step of optimizing an operation speed and an operation path of the main equipment using a genetic algorithm where an objective function is to at least reduce an amount of time which it takes to load or unload freight; and a main equipment halting step of operating the main equipment at the operation speed optimized in the optimization step and via the operation path optimized in the optimization step, and halting the main equipment after the loading and unloading operation is completed.

4. The method for controlling a port loading and unloading apparatus according to claim 3, further comprising a third step of:

if a temperature of the room becomes equal to or less than a predetermined room temperature judgment value while the port loading and unloading apparatus is in operation, judging that the electric power reduction condition is satisfied, and putting the room cooling device into the power saving mode; and if brightness of the room becomes equal to or greater than a predetermined room luminance judgment value, judging that the electric power reduction condition is satisfied, and putting the room lighting device into the power saving mode.

5. The method for controlling a port loading and unloading apparatus according to claim 2, further comprising a third step of:

if a temperature of the room becomes equal to or less than a predetermined room temperature judgment value while the port loading and unloading apparatus is in operation, judging that the electric power reduction condition is satisfied, and putting the room cooling device into the power saving mode; and if brightness of the room becomes equal to or greater than a predetermined room luminance judgment value, judging that the electric power reduction condition is satisfied, and putting the room lighting device into the power saving mode.

6. The method for controlling a port loading and unloading apparatus according to claim 1, further comprising a third step of:

if a temperature of the room becomes equal to or less than a predetermined room temperature judgment value while the port loading and unloading apparatus is in operation, judging that the electric power reduction condition is satisfied, and putting the room cooling device into the power saving mode; and if brightness of the room becomes equal to or greater than a predetermined room luminance judgment value, judging that the electric power reduction condition is satisfied, and putting the room lighting device into the power saving mode.

7. A port loading and unloading apparatus including auxiliary equipment, which is equipment other than main equipment for performing main operations of the port loading and unloading apparatus, the auxiliary equipment including a main equipment cooling device for cooling the main equipment, a loading and unloading lighting device for lighting a loading and unloading operation range, a room cooling device for cooling a room of the port loading and unloading apparatus, and a room lighting device for lighting the room, the apparatus comprising an auxiliary equipment controlling device for, if an operating condition of the main equipment or a room condition satisfies a predetermined electric power reduction condition while the port loading and unloading apparatus is in operation, putting the auxiliary equipment that is keeping the operating condition of the main equipment or the room condition into a power saving mode in which the auxiliary equipment consumes less electric power than in a normal operation.

* * * * *